US010154728B2

(12) United States Patent
Hailechristos

(10) Patent No.: US 10,154,728 B2
(45) Date of Patent: Dec. 18, 2018

(54) TOOTHPASTE DISPENSING TOOTHBRUSH

(71) Applicant: Miriam Hailechristos, West Covina, CA (US)

(72) Inventor: Miriam Hailechristos, West Covina, CA (US)

( * ) Notice: Subject to any disclaimer, the term of this patent is extended or adjusted under 35 U.S.C. 154(b) by 0 days.

(21) Appl. No.: 15/019,413

(22) Filed: Feb. 9, 2016

(65) Prior Publication Data

US 2016/0227915 A1 Aug. 11, 2016

Related U.S. Application Data

(60) Provisional application No. 62/115,063, filed on Feb. 11, 2015.

(51) Int. Cl.
*A46B 11/04* (2006.01)
*A46B 11/00* (2006.01)

(52) U.S. Cl.
CPC ..... *A46B 11/0055* (2013.01); *A46B 11/0024* (2013.01); *A46B 11/0027* (2013.01); *A46B 11/0031* (2013.01); *A46B 11/0034* (2013.01); *A46B 11/0037* (2013.01); *A46B 11/0079* (2013.01); *A46B 11/0096* (2013.01); *A46B 2200/1066* (2013.01)

(58) Field of Classification Search
CPC ..... A46B 11/0024; A46B 11/27; A46B 11/31; A46B 11/34; A46B 11/37; A46B 11/55; A46B 11/62; A46B 11/96
USPC ..... 401/277, 278, 286
See application file for complete search history.

(56) References Cited

U.S. PATENT DOCUMENTS

| | | | | |
|---|---|---|---|---|
| 2,328,048 | A * | 8/1943 | Bair | A46B 11/0055 15/143.1 |
| 2,948,007 | A | 9/1959 | Tanguay | |
| 4,277,194 | A | 7/1981 | Smith | |
| 5,039,244 | A * | 8/1991 | Cheng | A46B 11/0024 401/176 |
| 5,100,252 | A * | 3/1992 | Podolsky | A46B 11/0027 401/174 |
| 5,425,590 | A * | 6/1995 | Duty | A46B 11/0024 222/391 |
| 5,636,933 | A * | 6/1997 | Vizsolyi | A45D 44/18 132/308 |
| 5,755,523 | A * | 5/1998 | Seydel | A46B 11/0024 401/176 |
| 6,334,451 | B1 | 1/2002 | Yang | |
| D497,053 | S | 10/2004 | Mitthun | |
| 8,534,950 | B2 | 9/2013 | Sylvester | |
| 2007/0110503 | A1 * | 5/2007 | Glover | A46B 11/0024 401/134 |
| 2013/0279964 | A1 | 10/2013 | Booker | |

FOREIGN PATENT DOCUMENTS

GB 2400547 A 10/2004

* cited by examiner

*Primary Examiner* — Jennifer C Chiang

(57) ABSTRACT

A toothbrush comprising a brush head and neck, a hollow toothpaste storage chamber, and a plunger, in which the brush head has bristles and one or more apertures, and the neck is hollow. A portion of the plunger sits inside of the hollow storage chamber, and a spring sits inside of the hollow plunger. Alternatively, the plunger has a rod that has teeth on one side and a groove on the other side, to lock or unlock the plunger.

11 Claims, 12 Drawing Sheets

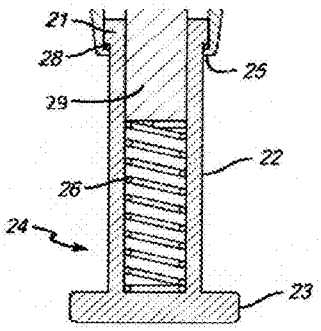
FIG. 6A
Cross Sectional View
Shows the bottom half of the
Toothpaste Dispensing Toothbrush –
With Spring On The Inside
FIG.6C
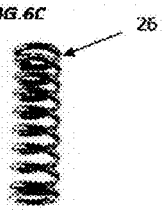
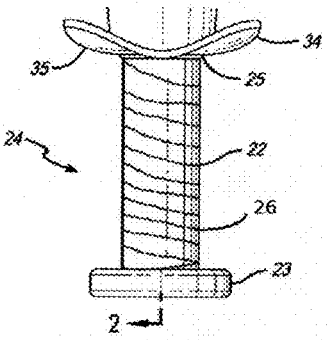
FIG.6B
Shows the bottom half of the
Toothpaste Dispensing Toothbrush –
With Spring On The Outside

TOOTHPASTE DISPENSING TOOTHBRUSH

CROSS-REFERENCE TO RELATED APPLICATIONS

This application claims the benefit of U.S. provisional application Ser. No. 62/115,063 filed Feb. 11, 2015, the disclosure(s) of which is hereby incorporated in its entirety by reference herein.

TECHNICAL FIELD

This invention is a toothpaste dispensing toothbrush, with a reusable dispenser and replaceable toothbrush.

BACKGROUND

Various tooth paste dispensing toothbrush devices have attempted to create methods for storing and applying toothpaste to a toothbrush, but they are all complex and not user-friendly, particularly for children.

The toothbrush devices previously attempted were complicated in construction and in operation, see U.S. Pat. Nos. 2,948,007, 4,277,194 and application US 2013/0279964. These devices rely on a cartridge type of implementation, where the reservoir of the toothpaste is disposable. This forces the consumer to purchase and rely on the disposable cartridges that are compatible with the system, and are not otherwise refillable by any other user preferred toothpaste. Many more previously attempted devices rely on complicated mechanisms for impelling the toothpaste up to the brush. These mechanisms include rotary thumb wheel drives, rotating knobs, or rotate and screw piston drives, such as, U.S. patents, U.S. Pat. Nos. 8,534,950 and 6,334,451, as well as all of the above referenced patents, U.S. Pat. Nos. 2,948,007, 4,277,194, and application US 2013/0279964.

There are many problems with 'rotate/screw' type mechanisms used to impel the toothpaste from a toothpaste container. The mechanism has a two-way motion, in that it can be screwed-up (when rotated clockwise) or screwed-down (when rotated counter-clockwise). This is confusing and even frustrating, particularly for children that don't yet have the idea of clock-wise and counter-clockwise. Furthermore, the rotation of the piston may be even more difficult for small children who have not yet developed the fine motor skills and the precise coordination required. In addition, in some of the aforementioned cases, as well as in others, the pistons or drivers slide down and detach completely, in which case that mechanical part can be lost.

SUMMARY

The present invention relates to toothbrush mechanisms having a storage chamber for containing toothpaste and a dispensing mechanism for selectively driving the paste forward, into communication with the toothbrush bristles. The simplicity of its mechanics and the reduced number of parts, versus prior devices, is most notably what makes this toothbrush easy to use and reuse, for adults as well as for children.

The dispensing mechanism, is unique in its design, is very simple and intuitive for the user, and mechanically uncomplicated. It employs a simple forward pumping mechanism consisting of a mechanical plunging implement. It does not rely on a rotating knob or thumb wheel drive, it does not rely on electronics and battery, it does not rely on separate and prefilled cartridges or specialized toothpaste tubes. This makes the manufacturing of this product simpler and more economical, as well as differentiating it in its form and its function from prior devices.

An additional embodiment of the invention comprises a toothbrush which has an alternative pumping mechanism that includes a method for stopping toothpaste from accidentally being impelled when not in use, and a method for stopping other particles, from running back down from the toothbrush neck into the toothpaste storage chamber.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
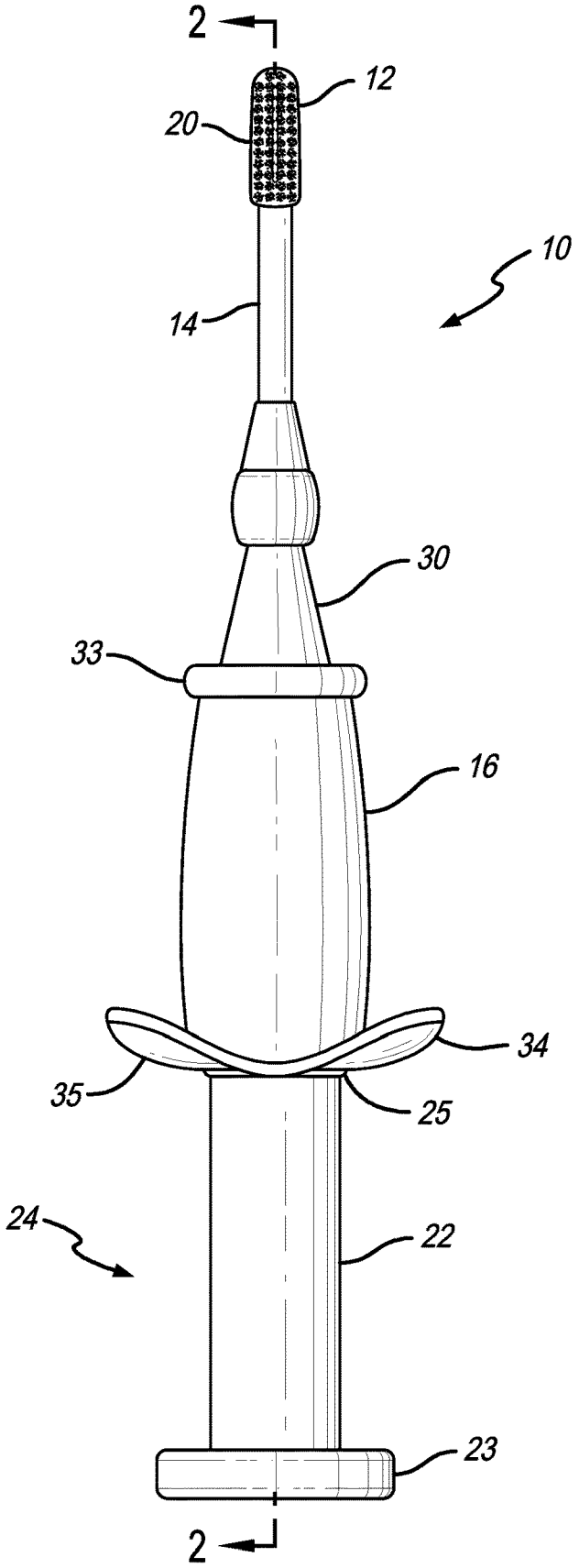
FIG. 1 is a front view of a toothbrush invention.
Figure 2:
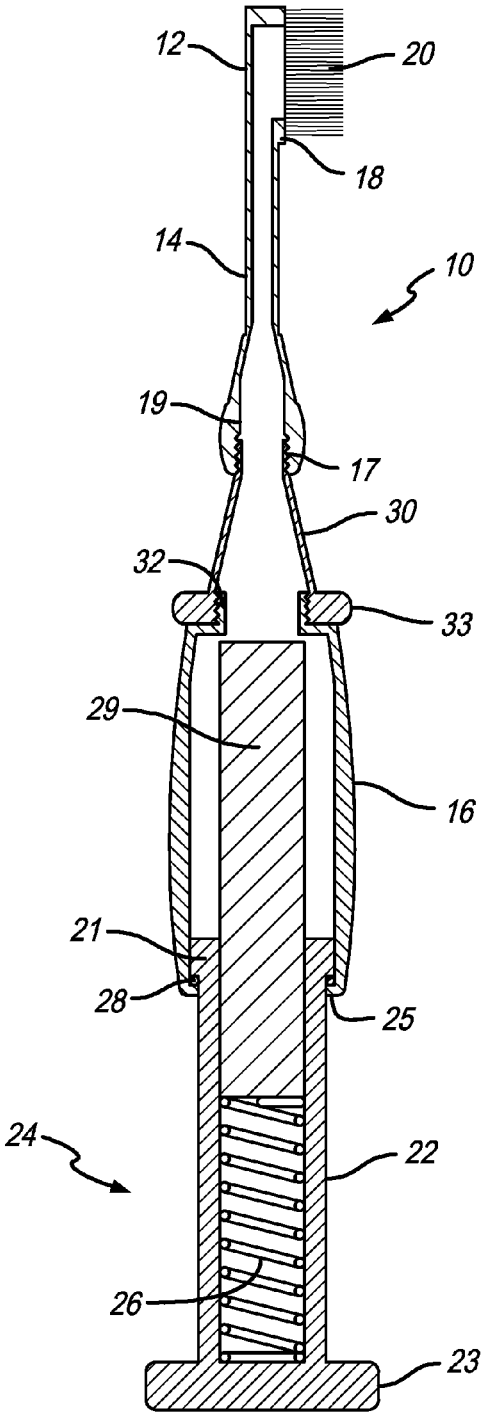
FIG. 2 is a cross-section view taken along lines 2-2 of FIG. 1.

FIGS. 1 and 2 show a toothbrush 10 comprising a toothbrush head 12 a toothbrush neck that is hollow 14, and a storage chamber 16, that is hollow and cylindrical, for holding toothpaste. Toothbrush head 12 and toothbrush neck 14 are removable and replaceable. Neck 14 is short and hollow, or semi-hollow, and head 12 has one or more outlet apertures 18 and a series of bristles 20. A plunging unit (or plunger) 24 is comprised of a piston head 21 and a piston rod 22 which has a flat base 23 so that the toothbrush 10 can stand upright. Base 23 can be circular, rectangular or any other convenient shape.

Chamber 16 contains the toothpaste. Plunger 24 is used to push the toothpaste forward and cause the toothpaste to travel through hollow neck 14 and out through an outlet aperture 18 and onto bristles 20. Piston rod 22 of plunger 24 enters through a hole in the bottom of chamber 16. Piston head 21 of plunger 24 sits in chamber 16 and has a larger diameter than the narrowed bottom 25 of chamber 16, so that the plunger 24 cannot dislodge from chamber 16 and fall out of the bottom of chamber 16. Piston head 21 optionally comprises a rubberized seal 28 along its circumference, to prevent toothpaste from coming out of the bottom of chamber 16 and to facilitate more optimal plunging of the toothpaste.

Stationary rod 29 runs from the top of chamber 16 down through a hole in the center of piston rod 22. Rod 29 extends down some distance to sit atop a coiled spring 26 encased inside piston rod 22. As the user pushes plunger 24 in a forward motion to push tooth paste up to the brush, spring 26 is compressed. When plunger 24 is released, spring 26 decompresses and pushes plunger 24 back down chamber 16, and piston head 21 having a larger diameter (versus the narrowed bottom 25 of chamber 16) prevents piston rod 22 from sliding out of chamber 16, thereby preventing plunger 24 from detaching from chamber 16.

Neck 14 of the toothbrush could optionally be constructed with a flexible neck, such as a rubberized and flexible portion, to enable some range of motion while brushing. This will not only facilitate better cleaning (versus it being stiff) but also alleviates some pressure from the rest of the toothbrush.

The bottom end 19 of toothbrush neck 14 attaches to the top 17 of cone head top 30 of chamber 16. Any attaching mechanism can be used, but ideally it is threaded and can be screwed on and screwed off.

Chamber 16, has a wide mouth receptacle that can be filled with any type of toothpaste, is refillable and re-usable.

Chamber 16 is ideally cylindrical, but can have any three dimensional geometric shape. Ideally the surface of storage chamber 16 is fully or partly transparent, such that the user can see when he/she needs to refill it with paste. Chamber 16 has a top 30 that tapers smoothly to a narrowed apex. It can be manufactured of a plastic material from a wide range of synthetic or semi-synthetic organic solids that are malleable. It can also incorporate any type of microbe-inhibiting product protection.

The cone head top 30 of chamber 16 is constructed such that it opens to allow access to the upper opening 32 of chamber 16 and the user can easily fill the 'wide mouthed' chamber 16 with the toothpaste of his or her choice. Various attaching mechanisms can be used to attach a cone head top 30 to the top 32 of chamber 16 but ideally cone head top 30 is threaded at the bottom 33 and the upper opening 32 of chamber 16 is also threaded, so that cone top 30 can be unscrewed to open it and screwed to close it.

The bottom end 25 of chamber 16 narrows to facilitate the housing of the plunger 24, which is described above.

The base of chamber 16 has wings 34 and 35, where the user can rest their fingers while pushing plunger 24 forward. The wings can be flat, but it is ideal that wings 34 and 35 flare up slightly at an angle, which is ergonomically superior.

Chamber 16 doubles as the toothbrush handle. As such, the outer surface of chamber 16 can have other features to facilitate the ease of use and the comfort of the user, such as a non-slip grip.

Figure 3:
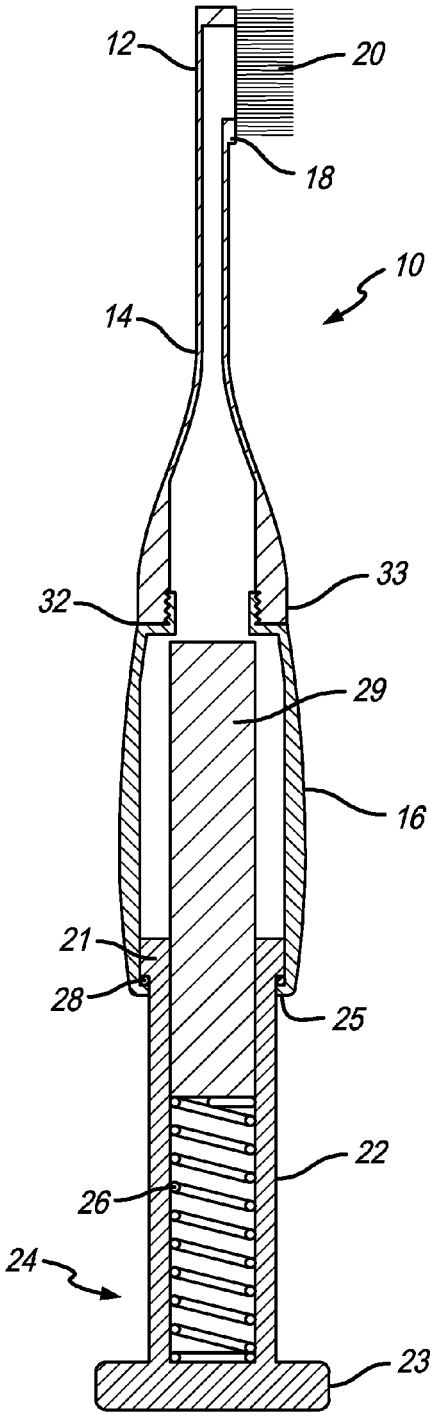
FIG. 3 is a cross-section view of another embodiment.

It is an option that the toothbrush head 12, neck 14 and chamber top 30 of chamber 16 can be constructed as one unit as shown in FIG. 3.

A mechanical plunging unit (comprising a plunger 24) and a retraction mechanism (comprising a stationary rod 29 and a coiled spring 26), are integrated into chamber 16, to create a simple and measured forward pumping mechanism of the toothpaste, a mechanism that is intuitive and easy to use, particularly for children.

Piston head 21 is fixedly attached to piston rod 22 and sits inside of chamber 16. Piston head 21 has a diameter that is larger than the narrowed bottom end 25 of chamber 16. This prevents piston rod 22 from sliding out of the bottom end of chamber 16. An optional rubberized seal 28, or a version of a malleable washer on piston head 21, prevents toothpaste from oozing out of the bottom of chamber 16, as well as facilitate better plunging.

Stationary rod 29 fits into piston rod 22. The base 23 of piston rod 22 optionally has a large circular or rectangular shape, or any design deemed optimal or appealing, to make pushing plunger 24 easy (particularly for children) but also enables toothbrush 10 to stand up on a flat surface (such as a counter or a table) while not in use.

The retraction mechanism of plunger 24 is facilitated by stationary rod 29 vertically resting on top of coiled spring 26 inside the bottom of piston rod 22 within chamber 16. Coil spring 26 is compressed when plunger 24 is pushed forward, and decompressed when plunger 24 is released, such that plunger 24 is pushed back in place after each forward motion, aiding a more measured dispensing of the toothpaste by releasing pressure off the paste, and readying itself for the next use.

The mechanical assembly of the toothbrush 10 is outlined. At the top is the removable and replaceable toothbrush head 12 and neck 14 attached to the top of toothpaste chamber 16. In the middle is toothpaste chamber 16 (doubling as the handle of the tooth brush) and at the bottom is plunger 24. As the user pushes plunger 24 in a forward motion, plunger 24 moves upward and the toothpaste is forcibly pushed out of the top of chamber 16 and injected, first into the neck 14 of the toothbrush and then injected ultimately into the head 12 of the brush and out through one or more apertures and onto its bristles 20.

In addition to the above described mechanical simplicity, (which should make both the manufacturing of the product as well as the use of it very easy), outlined below is a summary of the functional differentiators that make it an ideal toothbrush, especially for children.

Ease of use: the design innovations around the simpler plunging mechanism and the winged chamber make dispensing the toothpaste easier. In addition, toothpaste chamber 16 has a wide mouth that is easy to open and makes it simple for any toothpaste to be squeezed into it. It does not require a cartridge of any kind or special tube of tooth paste, differentiating it from the prior art.

Re-usability: The toothpaste chamber is partly or entirely transparent and makes the contents in it visible, making it easy to see when a refill is needed. When the toothpaste chamber is empty, one simply opens the top and refills it with the toothpaste of his or her choice. The wide mouthed toothpaste chamber makes refilling an easy task that even children can do. The assembly mechanism makes it easy and quick to disassemble, clean and reuse. One can keep the dispenser and only replace the toothbrush head (or toothbrush head and toothbrush neck) which can be detached and discarded, differentiating it from the prior art that is meant only for a 'single-charge dentifrice', and is designed to be disposed of when the dentifrice containing chamber is empty.

Other important design features optionally include: a flexible toothbrush neck, which may make brushing more comfortable and a wide base which allows the toothbrush to stand upright when not in use, reducing the contamination that can happen when a toothbrush is left lying down on the bathroom sink, for example, or stored in a toothbrush holder along with several other toothbrushes touching one another. The wide base also has enough room for one to write a unique identifier on it, such as his/her initials for example to differentiate it from others.

FIG. 3 shows the embodiment in which the head 12, neck 14, and cone head top 30 are all constructed together as one unit. Other than that, the embodiment is the same as shown in FIGS. 1 and 2. Optionally, chamber 16 and cone head top 30 can be constructed as one unit. However, cone head top 30 must open, such as having a flip top to fill chamber 16 with toothpaste.

Figure 4:
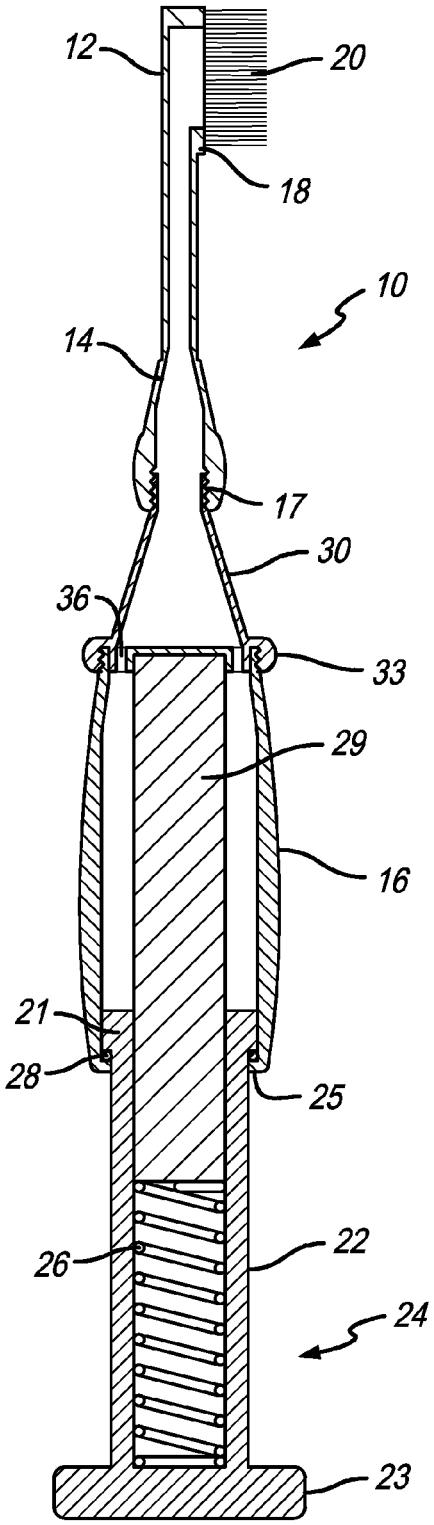
FIG. 4 is cross-section view of another embodiment.
Figure 5:
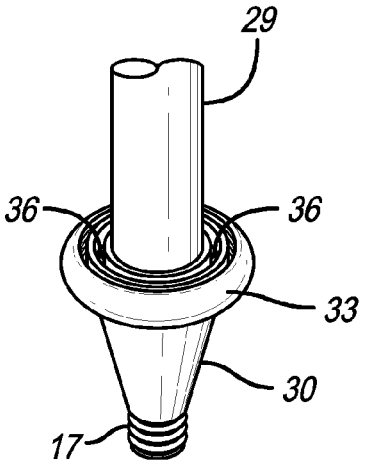
FIG. 5 is a front view of a portion of FIG. 4.

FIG. 4 shows another embodiment in which stationary rod 29 is fixedly attached to cone head top 30, or they are constructed together as one unit. In this embodiment, there are holes 36 in cone head top 30 for the paste to go through to neck 14, head 12 and bristles 20. Other than that, the embodiment is the same as shown in FIGS. 1 and 2.

Figure 6:
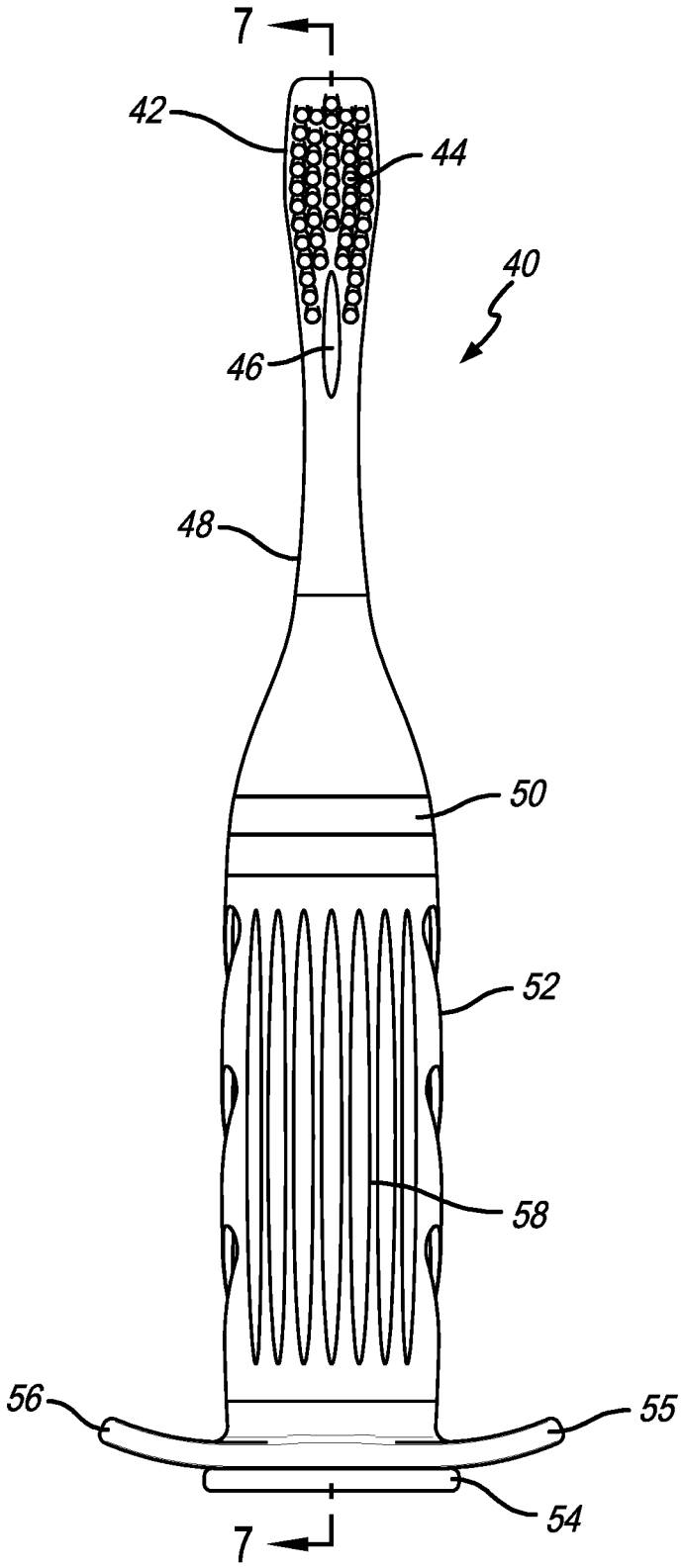
FIG. 6 is a front view of another embodiment of the invention.
Figure 7:
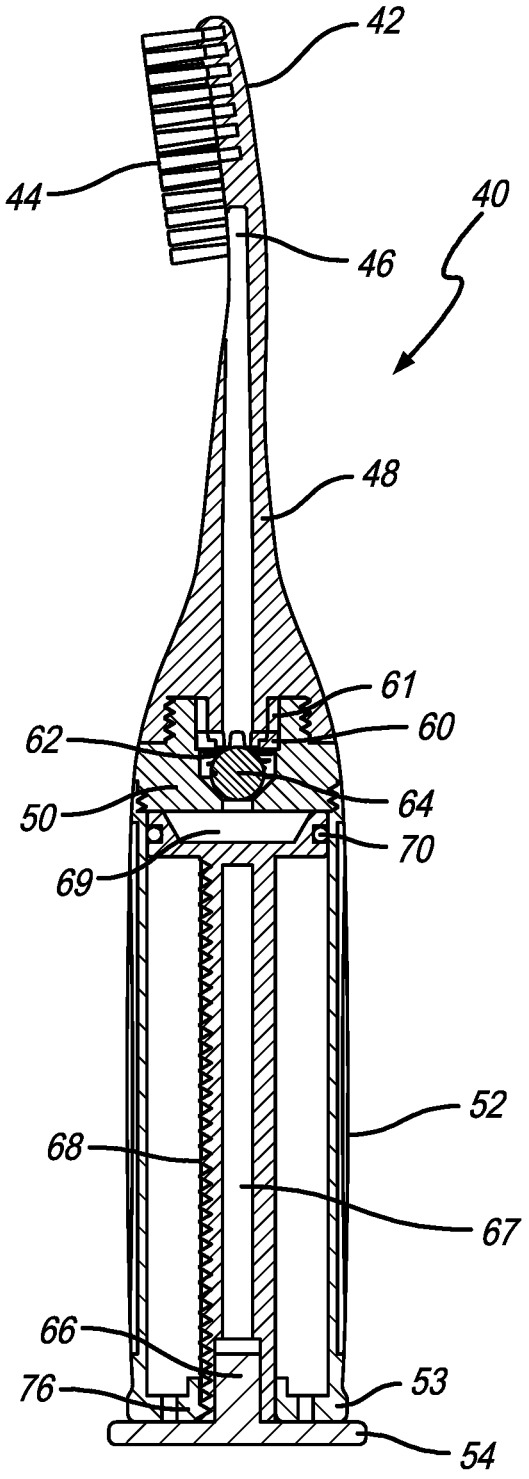
FIG. 7 is a cross-section taken on lines 7-7 of FIG. 6.

FIGS. 6 through 13 show another embodiment of the invention. FIG. 6 shows a front view of the toothbrush 40. There is shown the head 42 of the toothbrush having bristles 44 and an outlet aperture 46. The neck 48 is hollow (as shown in FIG. 7 cross section view). There is a chamber cap 50 containing a check valve system (shown in detail in FIG. 10). There is a hollow cylindrical chamber 52 which holds the toothpaste, a base plate 54 and a pair of wings 55 and 56 making it easier to hold and use the toothbrush. There is also an optional grip molding 58 on the exterior of chamber 52 for a better grip of the toothbrush—which can be made of varying designs, this embodiment shows grooves and ovals that allow the user to see through to the chamber 52, and know the level of toothpaste that is contained therein.

FIG. 6A shows a cross-sectional view of the bottom half of the present invention to explicitly show case the spring 26 housed inside the piston rod 22 of the plunger 24. And FIG. 6B also shows the bottom half of the present invention, illustrating that the spring 26 may alternatively be housed on the outside of the piston rod 22 of the plunger 24. The spring 26 (which is also shown separately in FIG. 6C) facilitates the auto retracting mechanism of the plunger 24. As the user pushes the plunger 24 in a forward motion, to dispense the toothpaste, the spring compresses, and when the user releases the plunger the spring decompresses and pushes the plunger back into place via a backward pressure, this automatically retracts the plunger, readying it for the next time it is used. This simple mechanical auto retracting mechanism serves at least two purposes: 1) it slows the rate at which the paste is dispensed and therefore makes for a more measured dispending of the paste, as the backward pressure slows the user from dispending too much paste at once, and 2) once the paste is dispensed, the release of the plunger's pressure off the paste, prevents continued and residual oozing of the paste. If Spring 26 is integrated on the outside of the piston rod 22 (as illustrated in FIG. 6B) versus on the inside (as illustrated in FIG. 6A), the stationary rod 29 will not be required.

Figure 8:
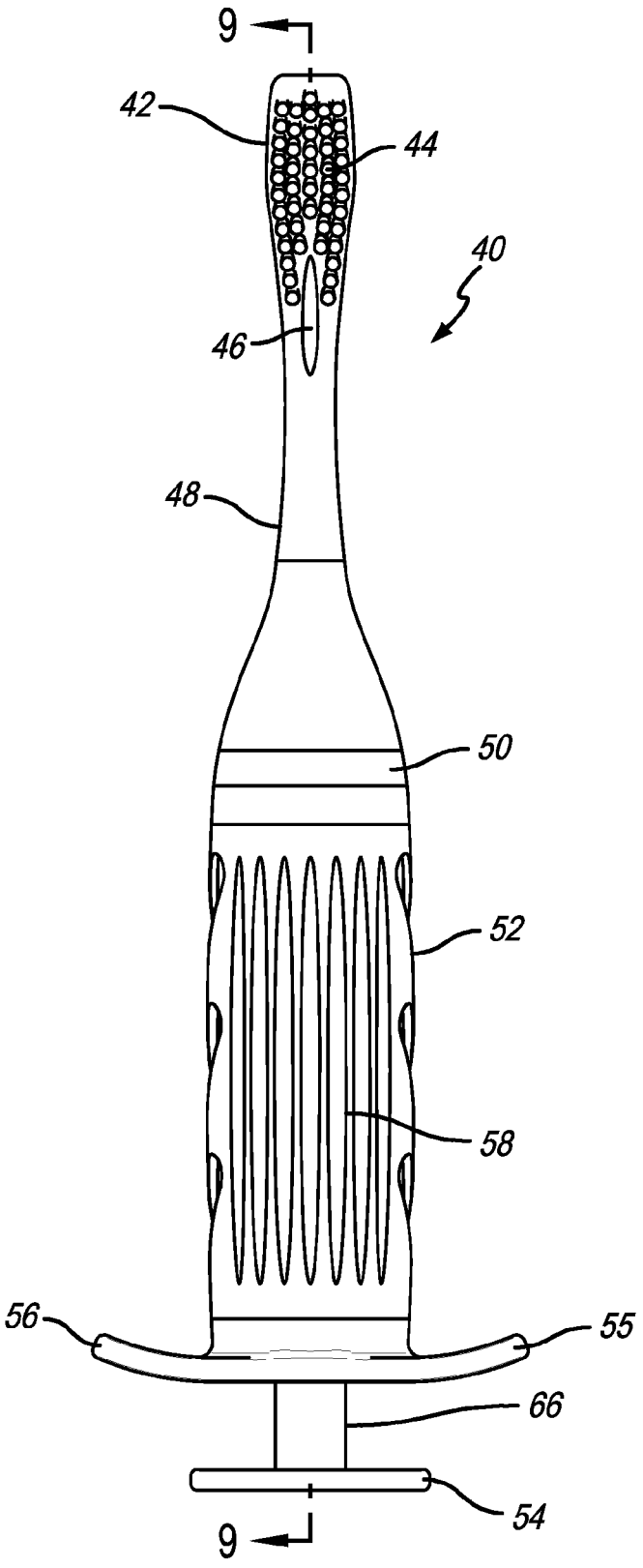
FIG. 8 is a front view of the embodiment of FIG. 6 with a plunger out some distance.
Figure 9:
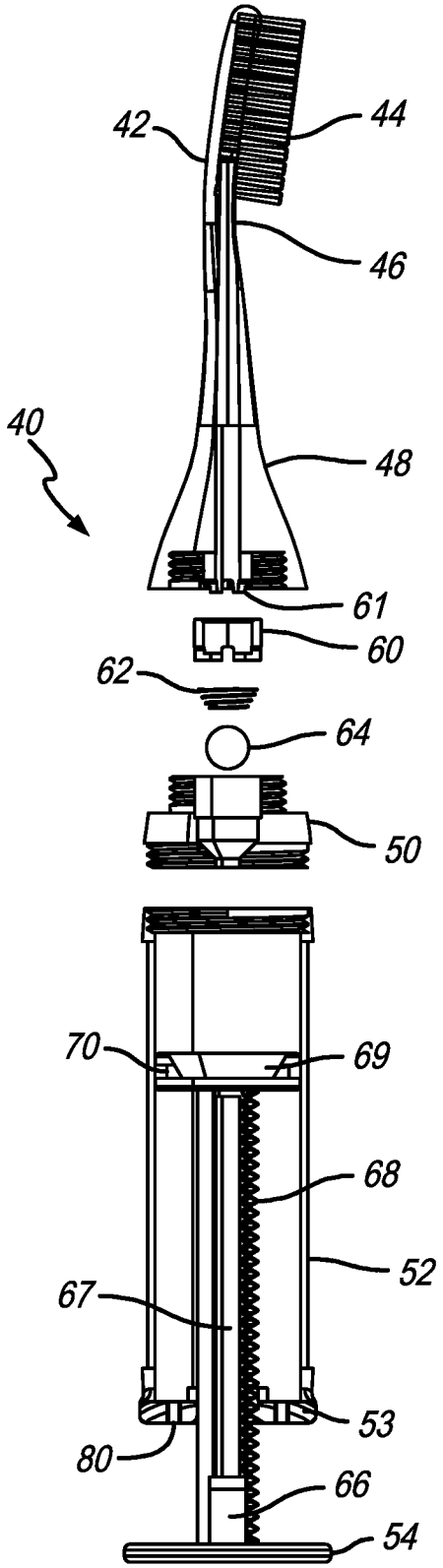
FIG. 9 is a cross-section exploded view taken on lines 9-9 of FIG. 8.

FIG. 8 is a full view of the toothbrush 40 with the piston rod 66 shown at some distance outside the chamber, and FIG. 9 is a cross-section and exploded view showing the inside of toothbrush 40. There is the head 42, having bristles 44 and an aperture 46. The hollow neck 48 of the toothbrush 40 allows the paste to travel through it and go out the outlet aperture 46 and onto the bristles 44. Chamber cap 50 bottom attaches to and seals the open top end of chamber 52 and the chamber cap top attaches to the hollow neck 48.

Figure 10:
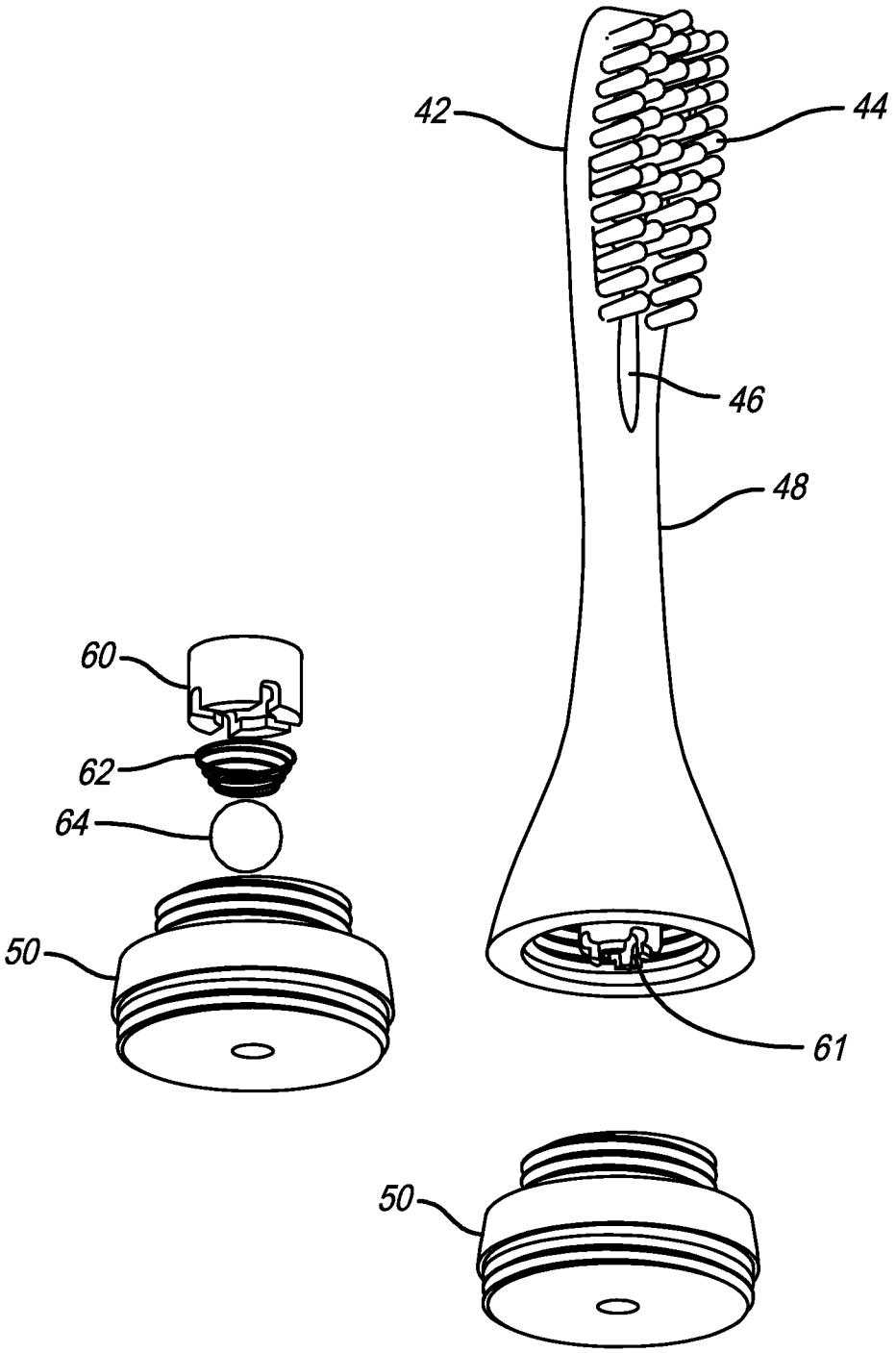
FIG. 10 is a perspective exploded view of the head, neck and check valve of the toothbrush of FIG. 6.

FIG. 10 shows in detail the check valve system which comprises a check valve retainer 60, a check valve spring 62, and a check valve ball 64. A boot 61 fits into check valve retainer 60. The check valve system is optional, and is one of many varying check valve systems that could be employed.

Figure 11:
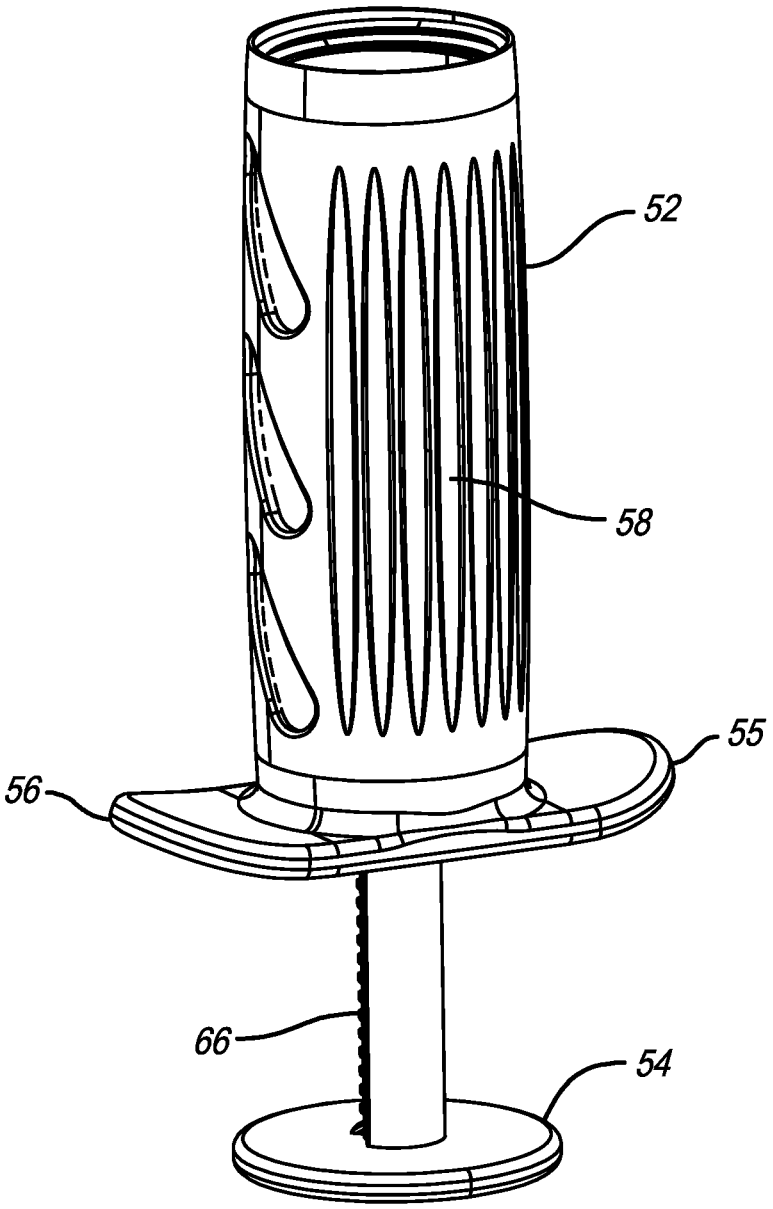
FIG. 11 is a perspective view of the chamber of FIG. 6, and part of a plunger.

FIG. 11 shows the hollow cylindrical storage chamber 52 which doubles as the toothbrush handle. It can be filled with any type of toothpaste. The grip molding 58 facilitates a better grip, while the wings 55 and 56 allow the user to rest their fingers on them while pushing the plunger 65 forward. Part of the plunger 65 (piston rod 66) is shown here some distance outside the chamber and has a base plate 54 upon which the toothbrush can stand upright.

Figure 12:
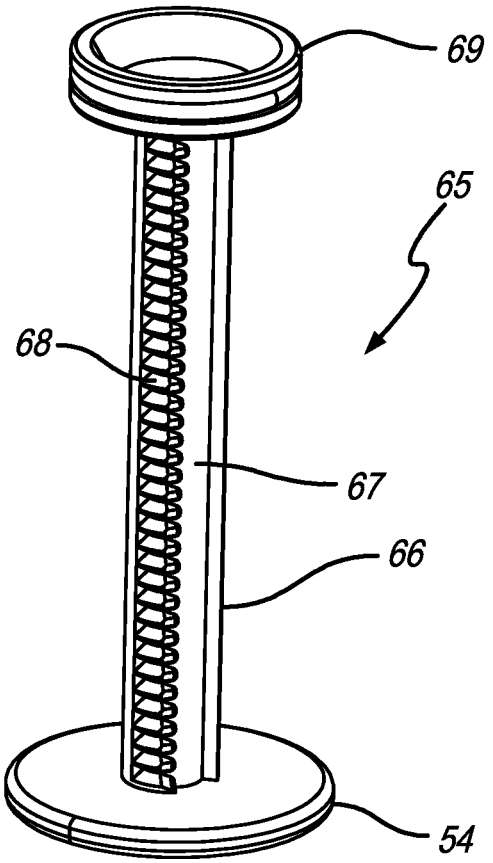
FIG. 12 is a perspective view of the plunger alone.

FIG. 12 shows a plunging unit (or plunger) 65; which is comprised of a piston head 69 and a piston rod 66 which has a flat base 54 so that the toothbrush 40 can stand upright. Piston head 69 is fixedly attached to piston rod 66 and sits inside of chamber 52. Piston head 69 has a diameter that is larger than the bottom opening 78 of chamber 52, shown in FIG. 13. This prevents piston rod 66 from sliding out of chamber 52. An optional rubberized seal 70, or a version of a malleable washer on piston head 69, prevents toothpaste from oozing out of the bottom of chamber 53, as well as facilitate better plunging.

Figure 13:
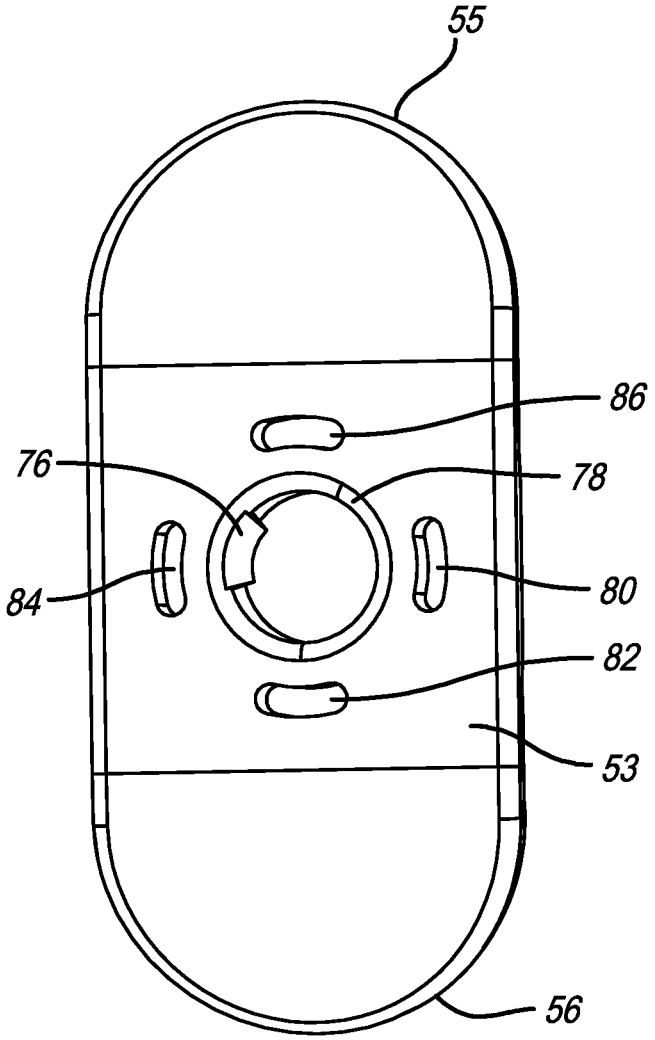
FIG. 13 is a bottom view of the chamber of FIG. 6.

The plunger mechanism has a locking system to stop accidental pushing of the plunger 65 thereby preventing unintended spillage of the toothpaste when toothbrush is not in use. This makes toothbrush 40 ideal for travel, where one does not have to worry about toothpaste spilling inside a purse or travel bag. The locking system is facilitated by a lip 76 shown in FIG. 13 (at the bottom 53 of chamber 52), and a piston rod 66 having teeth 68 (along one of its sides) and having a groove 67 (along the other one of its sides) designed to engage and disengage with lip 76, thereby locking and unlocking respectively. Piston rod 66 passes through bottom opening 78 into chamber 52, and when piston rod 66 is turned toward the side of the teeth 68, it engages lip 76 and locks plunger 65 from moving; when piston rod 66 is turned toward the side of groove 67 it disengages with lip 76 and the plunger 65 can move, so that it can push the paste up to the brush. Therefore, when locked, plunger 65 is prevented from accidentally pushing up the paste, such as when the toothbrush is in a travel bag or purse. FIG. 13 shows a plurality of slots such as 80, 82, 84 and 86 in chamber bottom 53 which will facilitate in cleaning out chamber 52.

Base plate 54 allows the toothbrush to stand upright. This minimizes contamination that results from a toothbrush being left face down in a bathroom sink or when toothbrush is bunched up in a jar or holder where it maybe touching other toothbrushes. There is also enough space on the base plate 54 for the user to put an identifier, such as a name or initials.

Referring especially to FIG. 10, there is shown the check valve system mentioned above, which is designed to prevent foreign particles, possibly coming from the toothbrush head and neck, from entering chamber 52 where the toothpaste is stored. If plunger 65 is pulled back instead of forward, it might result in a suction into chamber 52. In such instances, the check valve prevents particles from being pulled into chamber 52.

Check valve ball 64 prevents any particle that might travel back down the hollow neck 48. Check valve spring 62 is tapered to allow ball 64 to float up and permit paste to pass around it when paste is being impelled up, and allow ball 64 to rest back down when toothpaste is not being impelled. Check valve retainer 60 secures check ball 64 and spring 62 in place and keeps them from dislodging.

Both or either one of the check and lock mechanisms, described herein as the check valve system and the locking system, or variations thereof may be employed by any of the previously described and illustrated embodiments.

Therefore, is it considered that a lock (designed to prevent the plunger from moving inadvertently and spilling the toothpaste) an example of which is described here in paragraph [0051] as a 'locking system' that is facilitated by teeth and groove on piston rod 66 and lip on bottom of chamber 52 to allow plunger 65 to lock and unlock—may be employed on any one of the toothbrush embodiments. For example, (on the previously described and illustrated embodiments of FIG. 1), implementing teeth and groove on the piston rod 22 and a lip on the bottom of chamber 16 will allow plunger 24 to lock and unlock.

Similarly, the check mechanism (designed for preventing foreign particles from traveling down into the chamber) an example of which is described here in paragraphs [0053-0054] as 'check valve system' incorporated in the chamber cap 50 to prevent foreign particles from making their way into chamber 52, may be employed on any one of the toothbrush embodiments. For example, (on the previously described and illustrated embodiments of FIG. 1), implementing check valve system on chamber cap 30 will prevent foreign particles from making their way into chamber 52.

As required, detailed embodiments of the present invention are disclosed herein; however, it is to be understood that the disclosed embodiments are merely exemplary of the invention that may be embodied in various and alternative forms. The drawings are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

What is claimed is:

1. A toothbrush comprising: a brush head, a hollow neck, a hollow toothpaste storage chamber and a plunger; the brush head comprising bristles and one or more apertures through which paste reaches the bristles; a plunger, comprising a piston head and a piston rod for pushing paste; the plunger movable inside of the storage chamber and the diameter of the piston head being larger than the narrowed bottom of the storage chamber; a cap sealing the top of the chamber, the cap having an opening through which toothpaste may pass; the plunger having a lock to stop accidental pushing of the plunger, in which the plunger lock comprises the piston rod having teeth on one side and a groove on the other side, the piston rod rotatable back and forth between the teeth side and the groove side, the chamber having a bottom with an opening, the opening having an extended lip, and when the teeth side engage the lip, the plunger is locked from movement and when the groove side engages the lip, the plunger is movable within the storage chamber.

2. The toothbrush of claim 1 in which a base of the piston rod is flat, on which the toothbrush can stand upward.

3. The toothbrush of claim 1 in which the hollow storage chamber has a winged base for holding the toothbrush.

4. The toothbrush of claim 1 in which the cap comprises a check valve which blocks paste or particles from going back into the chamber.

5. The toothbrush of claim 4 in which the check valve comprises a check valve retainer, a check valve spring and a check valve ball.

6. The toothbrush of claim 1 in which the base of the chamber has an opening through which the piston rod enters the storage chamber.

7. The toothbrush of claim 1 in which the base of the chamber has a plurality of slots for cleaning of the storage chamber.

8. The toothbrush of claim 1 in which the piston head has a seal to prevent toothpaste from oozing out of the chamber.

9. The toothbrush of claim 1 in which the base of the chamber has a grip molding on the exterior of the chamber.

10. The toothbrush of claim 1 in which the bottom of the cap attaches to the top of the chamber and the top of the cap attaches to the hollow neck.

11. A toothbrush comprising: a brush head, a hollow neck, a hollow toothpaste storage chamber, and a plunger mechanically auto retractable; the plunger comprising a stationary rod and a coiled spring integrated into a piston rod, which provides a measured forward pumping of toothpaste in the storage chamber, where the plunger is pushed back in place by the spring after each forward pumping, a check valve comprising a check valve retainer, a check valve spring and a check valve ball which stops paste and foreign particles from running back down from the toothbrush neck into the storage chamber, and a locking system locking the plunger to stop spillage of paste, comprising a lip at the bottom of the storage chamber, and the piston rod having teeth on one side and a groove on the other side to engage and disengage with the lip for locking and unlocking the plunger.

* * * * *